US010844599B2

(12) United States Patent
Rimmer et al.

(10) Patent No.: US 10,844,599 B2
(45) Date of Patent: Nov. 24, 2020

(54) CEILING BEAM GRID

(71) Applicant: Price Industries Limited, Winnipeg (CA)

(72) Inventors: Julian Rimmer, London (GB); Jordan Hiebert, London (GB); Marc Louis Hebert, Lorette West (CA); Sylvia Bistrong, Miami, FL (US); Alexandra Fom, Miami, FL (US); Gustavo Cardero, Miami, FL (US); Dan Ducharme, Winnipeg (CA); Srivani Bahumanyam, Winnipeg (CA)

(73) Assignee: Price Industries Limited, Winnipeg (CA)

( * ) Notice: Subject to any disclaimer, the term of this patent is extended or adjusted under 35 U.S.C. 154(b) by 0 days.

(21) Appl. No.: 16/657,348

(22) Filed: Oct. 18, 2019

(65) Prior Publication Data

US 2020/0131765 A1 Apr. 30, 2020

Related U.S. Application Data

(60) Provisional application No. 62/749,732, filed on Oct. 24, 2018.

(51) Int. Cl.
*E04B 9/34* (2006.01)
*E04B 9/00* (2006.01)
(Continued)

(52) U.S. Cl.
CPC ..... *E04B 9/345* (2013.01); *E04B 9/006* (2013.01); *E04B 9/20* (2013.01); *E04B 9/225* (2013.01)

(58) Field of Classification Search
CPC ... E04B 9/34; E04B 9/345; E04B 9/36; E04B 9/363; E04B 9/366; E04B 9/006;
(Continued)

(56) References Cited

U.S. PATENT DOCUMENTS 2,607,455 A 8/1952 Yellin
2,689,026 A 9/1954 Zingone
(Continued)

FOREIGN PATENT DOCUMENTS

| | | |
|---|---|---|
| CN | 30092511 | 5/2009 |
| IL | 28794 | 10/1999 |
| KR | 300794275.0000 | 4/2015 |

OTHER PUBLICATIONS

The International Search Report/Written Opinion issued by the U.S. Receiving Office dated Jan. 23, 2020 for corresponding PCT application No. PCT/US2019/056969; 7 pages.
(Continued)

*Primary Examiner* — Kyle J. Walraed-Sullivan
(74) *Attorney, Agent, or Firm* — Smith Gambrell & Russell LLP

(57) ABSTRACT

A ceiling beam grid is an open grid constructed from beams of a few standard sizes that are connected together by connection blocks at the intersections of the beams. The connection blocks are suspended from the structural ceiling of the room by means of an anchor and hanger and are spaced in a grid pattern to accommodate the standard size beams between adjacent connection blocks. The standard size beams are then attached to and supported between the connection blocks. The beams are connected to the connection blocks by a vertical tongue and groove connection. The tongue and groove connection provides a sliding connection that allows the beams to be easily connected and disconnected from the connection blocks without the need of tools. Consequently, the ceiling beam grid can be easily reconfigured to accommodate changes in the room below.

8 Claims, 8 Drawing Sheets

(51) Int. Cl.
*E04B 9/22* (2006.01)
*E04B 9/20* (2006.01)

(58) Field of Classification Search
CPC ... E04B 9/20; E04B 9/225; E04B 9/12; E04B 9/127; E04B 9/14; E04B 9/242; E04B 9/28; E04B 9/18
USPC .... 52/220.6, 506.06, 506.07, 506.05, 506.08
See application file for complete search history.

(56) References Cited

U.S. PATENT DOCUMENTS 2,725,126 A 11/1955 Ely
2,725,127 A 11/1955 Barrett
3,050,162 A 8/1962 Zingone
3,373,275 A 3/1968 High
3,471,981 A 10/1969 Segil
3,526,067 A 9/1970 Seghizzi
3,602,955 A 9/1971 Schwartz
D224,521 S 8/1972 Zura
3,785,110 A * 1/1974 Galloway ..... E04B 9/14 52/715
3,996,716 A * 12/1976 Tuten ..... E04B 9/14 52/665
4,015,389 A * 4/1977 Thompson ..... E04B 9/14 52/475.1
4,019,300 A * 4/1977 Sauer ..... E04B 9/067 52/665
4,034,463 A 7/1977 Ryan
4,175,360 A 11/1979 Mulvey
4,276,731 A * 7/1981 Henggeler ..... E04B 9/14 52/506.08
4,540,847 A * 9/1985 Gardner ..... E04B 9/064 174/491
4,548,010 A * 10/1985 Hintsa ..... E04B 9/003 52/506.09
4,570,391 A * 2/1986 Quante ..... F24F 13/28 52/39
4,674,254 A * 6/1987 Koehler ..... E04B 9/14 52/506.06
4,683,699 A * 8/1987 Larsson ..... E04B 9/064 52/775
4,722,161 A 2/1988 Young
4,724,650 A * 2/1988 Carey ..... E04B 9/14 52/650.3
D297,668 S 9/1988 Smith
4,949,517 A 8/1990 Blitzer
5,239,801 A * 8/1993 Adams ..... E04B 9/0478 52/506.07
D341,668 S 11/1993 Herter
5,349,800 A * 9/1994 Peng ..... E04B 9/127 403/174
D357,544 S 4/1995 Spransy
5,469,681 A * 11/1995 Wu ..... E04B 9/064 403/174
6,158,186 A * 12/2000 Feller ..... E04B 9/02 52/506.05
D462,548 S 9/2002 Ludwig
6,502,363 B1 * 1/2003 Roth ..... E04B 9/18 52/714
7,260,919 B1 * 8/2007 Spransy ..... E04B 9/183 52/585.1
D588,715 S 3/2009 Funk
8,835,776 B2 * 9/2014 Li ..... B61B 3/00 174/135
D777,945 S 1/2017 Killian
9,702,151 B2 7/2017 Cohen
2005/0072090 A1 * 4/2005 Mclaughlin ..... H02G 3/281 52/506.06
2005/0286256 A1 * 12/2005 Tran ..... E04B 9/006 362/404
2006/0130418 A1 6/2006 Juten
2006/0272256 A1 * 12/2006 Frecska ..... E04B 9/068 52/506.07
2008/0250731 A1 10/2008 Wheeler
2010/0043330 A1 * 2/2010 Svensson ..... E04B 9/14 52/506.08
2010/0077682 A1 * 4/2010 Adams ..... E04B 9/006 52/220.6
2010/0130055 A1 * 5/2010 Liang ..... H01R 25/147 439/532
2014/0112711 A1 * 4/2014 Hertweck ..... F16B 1/00 403/297
2015/0259909 A1 9/2015 Wang et al.
2016/0265224 A1 9/2016 Byers et al.
2018/0058068 A1 3/2018 Bergman
2018/0224103 A1 * 8/2018 Crandell ..... F21S 8/061
2018/0251977 A1 9/2018 Rimmer et al.
2019/0112809 A1 4/2019 Frantz

OTHER PUBLICATIONS

The Office Action with Restriction Requirement issued by U.S. Patent & Trademark Office dated Jul. 7, 2020 for corresponding U.S. Appl. No. 29/673,124; 11 pages.
Fsmanybest ceiling grid http://www.fsmanybest.com/Aluminum-Coffered-Drop-Down-Grid-Ceiling-Tiles-Covers-pd23987167.html; available Oct. 23, 2019 (Year: 2019).
Grid Modular Ceiling PDF https://priceindustries.com/resources/assistants/permlink/2976?_hstc=133302801.51feb1d203bb9712a22bc4f97f40aebcb.1592929722696.1592929722696.1592929722696.1&_hssc=13302801.2159292972269 6&_hsfp=2426723598 Retrieved Jun. 23, 2020 (Year: 2020).
SASOpen Cell Ceilings SAS International Progressive Materials https://www.progressivematerials.com.au/product/sas-800/SET 2018 (Year: 2018).

* cited by examiner

FIG.5
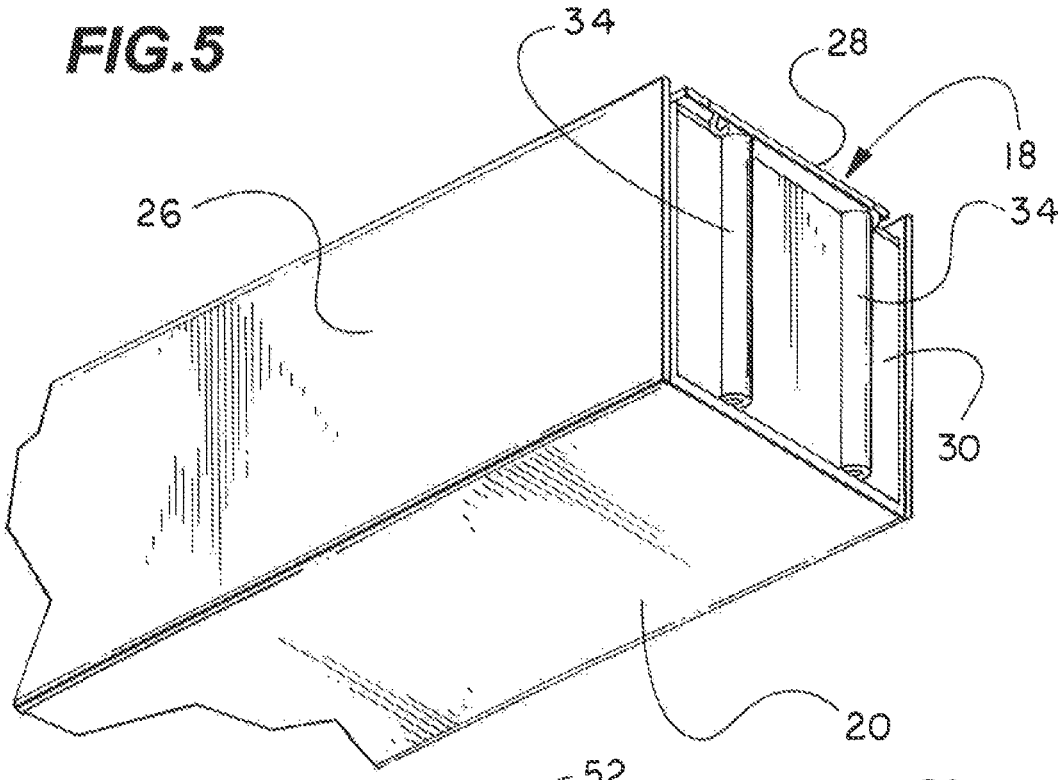
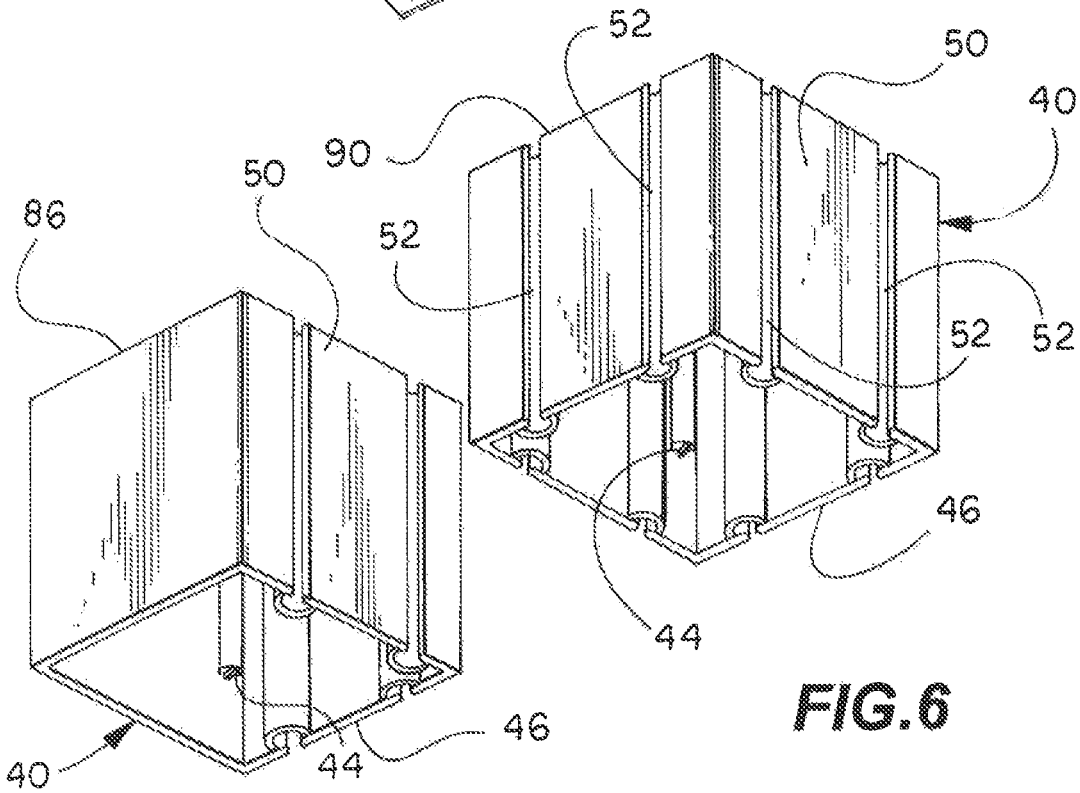
FIG.6

CEILING BEAM GRID

CLAIM OF PRIORITY

This application claims priority from U.S. Provisional Patent Application Ser. No. 62/749,732, filed on Oct. 24, 2018, which is incorporated herein in its entirety.

FIELD OF THE INVENTION

This invention relates to a ceiling system and more particularly a modular, open, and reconfigurable suspended ceiling system formed of interlocking beams and connection blocks that are designed to house and service a variety of building service devices.

BACKGROUND OF THE INVENTION

In commercial buildings, drop ceilings are frequently installed in the rooms in order to provide a closed space between the structural ceiling of the building and the drop ceiling to accommodate and conceal mechanical and electrical systems. In order to service the room below, the drop ceiling provides support for a variety of devices including, but not limited to room lights, emergency lights, cameras, speakers, sensors, Wifi access points (WAP), cell phone repeaters, drop-down signage, and HVAC grilles.

A conventional drop ceiling typically includes a matrix of tracks that is suspended from a hanger attached to an anchor in the structural ceiling. The hanger typically engages hooks or openings in the tracks. The tracks form a support matrix for the drop ceiling. Ceiling panels are then removably supported on the support matrix of the drop ceiling.

Once installed, the ceiling panels and frame matrix of a conventional drop ceiling support the devices required to service the room or occupied space below. If, however, the room is reconfigured to accommodate a different purpose than originally intended, the drop ceiling must be reconfigured as well. The reconfiguration of the room may require that portions of the drop ceiling be removed or portions added where walls have been moved.

Further, the devices may have to be relocated even if the size of the drop ceiling is not changed. In order to accomplish the required relocation of devices, each individual device must be disconnected, uninstalled, reinstalled, and then reconnected. Such relocation of individual devices is time consuming and often requires the services of a skilled craftsman, typically an electrician.

SUMMARY OF THE INVENTION

The present invention addresses the need for an attractive ceiling means of delivering building services that is modular in nature and easily reconfigured to accommodate reconfiguration of a room or other occupied space below. In that regard, a ceiling beam grid of the present invention offers an alternative to a conventional drop ceiling.

The ceiling beam grid of the present invention is an open grid constructed from beams of a few (generally two) standard sizes that are connected together by square connection blocks at the intersections of the beams that make up the ceiling beam grid. The connection blocks are suspended from the structural ceiling of the room by means of an anchor and hanger and are spaced in a grid pattern to accommodate the standard size beams between adjacent connection blocks. The standard size beams are then attached to and supported between the connection blocks.

Particularly, in one embodiment, the beams are connected to the connection blocks by a vertical tongue and groove connection. The tongue and groove connection provides a sliding connection that allows the beams to be easily connected and disconnected from the connection blocks without the need for tools. In a second embodiment, the beams are connected to the connection blocks by three alignment bolts on each beam that engage keyholes on the connection blocks. Nuts on the bolts are then tightened to secure the connection between the beams and connection blocks. Other detachable connections can be used to connect the standard size beams to the connection blocks. In other embodiments, the beams are connected to the connection blocks or the ends of other beams such as a tab and keyhole connection, a hook and slot connection, or a horizontal tongue and groove connection. Consequently, the ceiling beam grid can be easily reconfigured to accommodate changes in the room below.

In one embodiment of the ceiling beam grid, the standard size beams are hollow and four-inch square. The one embodiment has two standard size beams, one 2 feet long and the other 8 feet long. The bottom of each beam has a planar surface that faces the room, and the sides of each beam also have planar surfaces. The bottom planar surface accommodates a variety of openings that allow for the installation of various devices, including but not limited to room lights, emergency lights, cameras, speakers, sensors, Wifi access points (WAP), cell phone repeaters, drop-down signage, and HVAC grilles. In one aspect of the invention, a separate beam may be assigned a specific device. For example, a first beam may support wall washer lights; a second beam may support linear down lights; a third beam may support individual down lights; a fourth beam may support a speaker; a fifth beam may support a security camera; and a sixth beam may support sensors (temperature, occupancy, illumination, smoke, etc.). For example, reconfiguring the lights for the room may simply require the substitution of one beam with wall washer lights for another beam with individual down lights. In that way, the devices do not have to be uninstalled and reinstalled in individual beams.

The top of the beam has an elongated opening that allows access to a channel formed by the bottom and sides of the beam. A beam cover closes the top opening of the beam once the devices have been installed and the electrical connections made.

In a first embodiment, the ends of each beam have two vertically extending tongues. In a second embodiment the ends of each beam have three extending bolts. The ends of each beam further have openings that allow wires from the connection block to pass into the channel of the beam.

The connection block is a hollow square that is generally four-inch square to match the beam size. The connection block has a planar bottom surface that faces the room, four sides, and a top opening with a top cover. The connection block is supported from the structural ceiling by means of ceiling anchor, a hanger in the form of a conduit, and connection block support in the form of a threaded stub on the connection block. In a first embodiment, the sides of the connection block have vertically extending grooves that engage the matching vertically extending tongues on the ends of the standard size beams. The connection block could have tongues and the ends of the standard size beams could have grooves. In a second embodiment, the sides of the connection blocks have three keyholes that align with three extending bolts on the ends of each beam. Other suitable disengageable connection configurations can be used. Further, the sides of the connection block have openings that match the openings in the ends of the beams to accommodate wires running from the connection blocks to the channels in the beams and then to the devices mounted in the beams.

The connection block has multiple configurations including, a one-way connection block with vertical grooves on one side, a two-way straight connection block with vertical grooves on opposite sides, a two-way 90° connection block with vertical grooves on adjacent sides, a three-way connection block with vertical grooves on three sides, and a four-way connection block with vertical grooves or keyholes on all four sides. The configurations allow the connection block to serve as an end piece for a beam (one-way connection block), a corner piece (two-way 90° connection block), an extension piece (two-way straight connection block), a T connector piece (three-way connection block), and a cross piece (four-way connection block).

The ceiling beam grid includes electrical drivers located remotely from the ceiling beam grid. The drivers provide low voltage power to the ceiling beam grid as well as control signals for controlling the devices. The drivers are connected to the ceiling beam grid by driver wires running from the drivers to one or more of the connection blocks. The driver wires terminate in an electrical multiport box located in the connection block. The multiport box has female receptacles on each of its four sides. The female receptacles provide connections for low voltage and control signals in each of the four directions defined by the sides of the connection block. Device wires from devices installed in the beams run from the devices through the channel of the beam, through the matching holes in the end of the beam and the side of the connection block and terminate in male plugs.

The ceiling beam grid is assembled by first suspending the connection blocks from the structural ceiling by means of the anchor and hanger attached to the threaded stub of the connection block. The connection blocks are spaced to accommodate the standard size beam dimensions and the particular ceiling configuration. The hanger is a conduit through which the driver wires are threaded from the remotely located driver or drivers to the electrical multiport box in the connection blocks. Once the connection blocks have been hung from the structural ceiling, the standard size beams are connected between the properly spaced connection blocks. The installation of the standard size beams is accomplished without the need for tools by sliding the vertical tongues on the ends of the beams into the matching vertical grooves on the sides of the connection blocks. The vertical sliding of the tongues of the beams into the grooves of the connection block is arrested by stops at the end of the grooves or tongues.

Once the beams have been installed, the wiring of the devices is implemented by inserting the plugs into the receptacles of the multiport box to connect the low voltage power and the control signals to the devices in each of the beams. The installation is complete by attaching the top covers to the beams and to the connection blocks.

Further objects, features and advantages will become apparent upon consideration of the following detailed description of the invention when taken in conjunction with the drawings and the appended claims.

BRIEF DESCRIPTION OF THE DRAWINGS

FIG. 5 is a bottom perspective view of a partial beam of the ceiling beam grid in accordance with the present invention.

FIG. 6 is a perspective view of connection blocks (turned upside down) of the ceiling beam grid in accordance with the present invention.

DETAILED DESCRIPTION OF THE PREFERRED EMBODIMENTS

Figure 1:
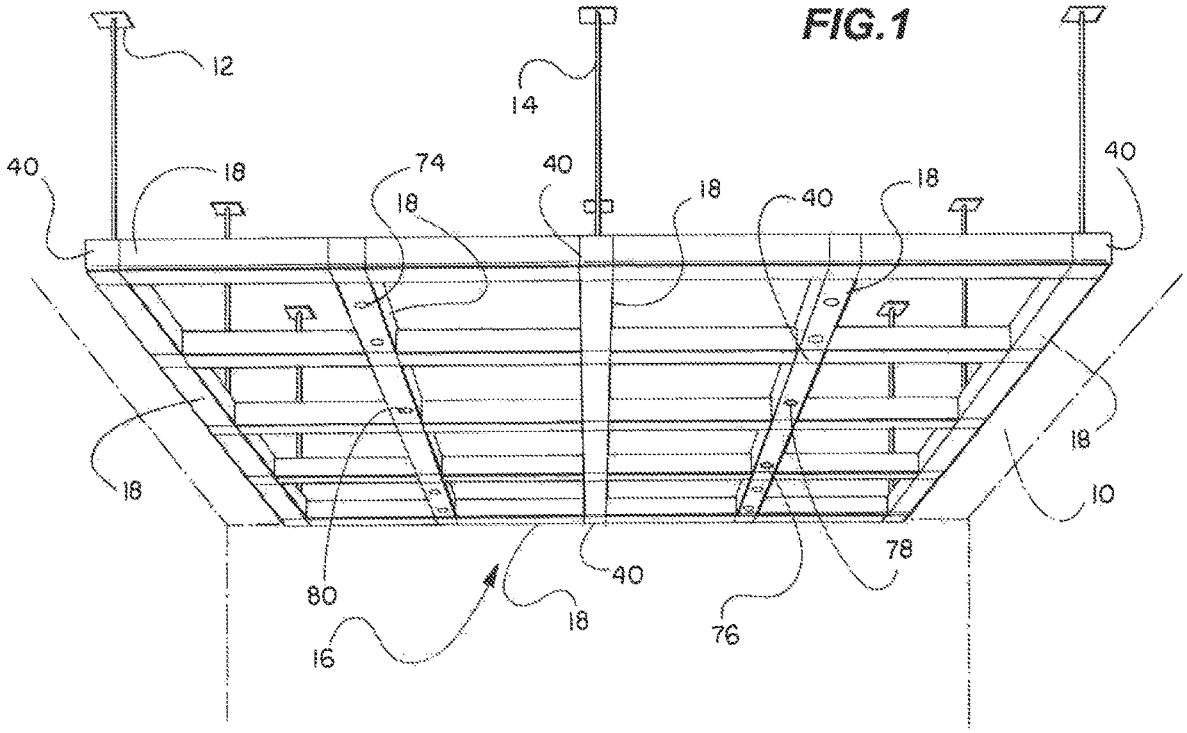
FIG. 1 is a bottom room side perspective view of a ceiling beam grid in accordance with the present invention.

Turning to FIGS. 1-8F, a ceiling beam grid 16 of the present invention is an open grid constructed from beams 18 of a few (generally two) standard sizes that are connected together by square connection blocks 40 at the intersections of the beams 18 that make up the ceiling beam grid 16. The connection blocks 40 are suspended from the structural ceiling 10 of the room by means of anchors 12 attached to the structural ceiling 10 and hangers 14. The connection blocks 40 are spaced in a grid pattern to accommodate the standard size beams 18 between adjacent connection blocks 40. The standard size beams 18 are then attached to and supported between the connection blocks 40. Particular, in one embodiment, the beams 18 are connected to the connection blocks 40 by a vertical tongue and groove connection comprising vertical tongues 34 in the ends 30 of the beams 18 and vertical grooves 52 in the sides 50 of the connection blocks 40. The tongue and groove connection provides a sliding connection that allows the beams 18 to be easily connected and disconnected from the connection blocks 40 without the need of tools. Consequently, the ceiling beam grid 16 can be easily reconfigured to accommodate changes in the room below. Other detachable connections can be used to connect the standard size beams 18 to the connection blocks 40, such as tab and keyhole connection, a hook and slot connection, a threaded bolt and nut arrangement, or a horizontal tongue and groove connection.

Figure 7:
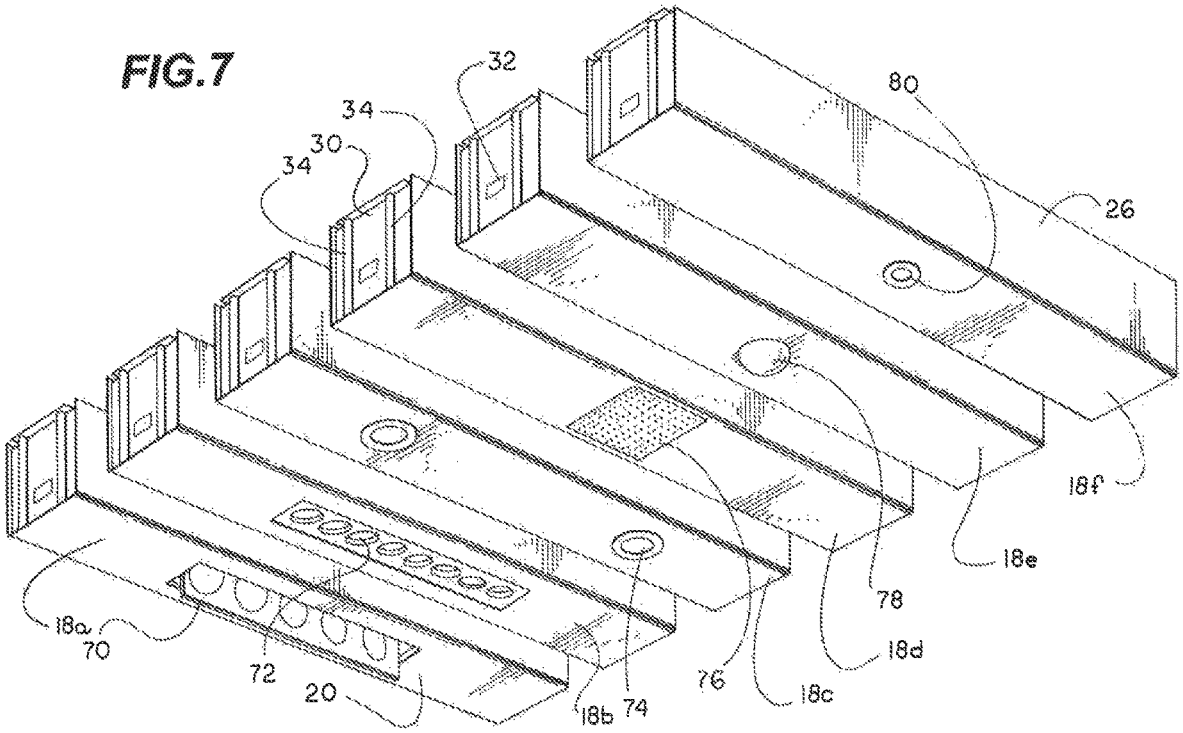
FIG. 7 is a bottom perspective view of a series of partial dedicated device beams of the ceiling beam grid in accordance with the present invention.
Figure 8A:
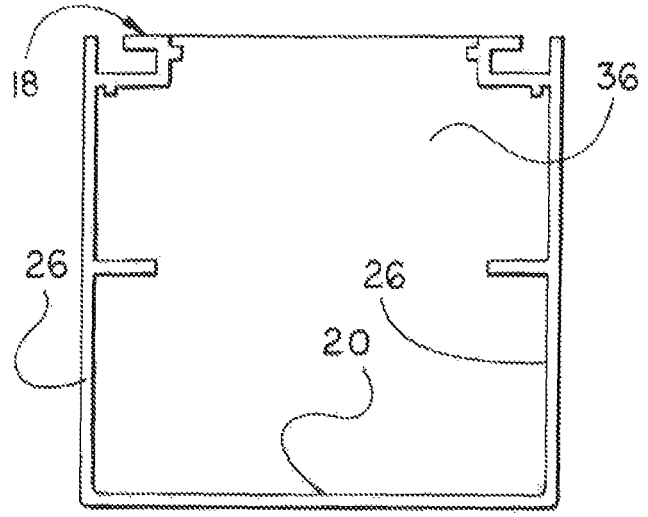
FIG. 8A is a cross-section view of the beam of the ceiling beam grid in accordance with the present invention.
Figure 8B:
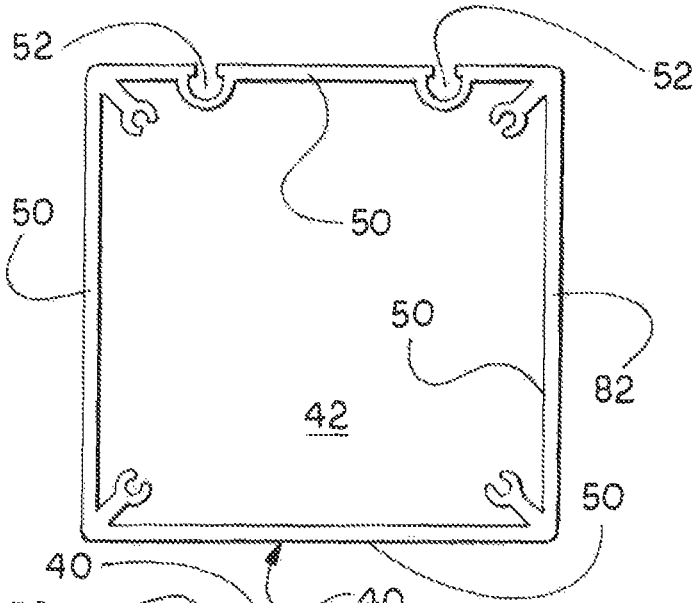
FIG. 8B is a top plan view of a one-way connection block in accordance with the present invention.
Figure 8C:
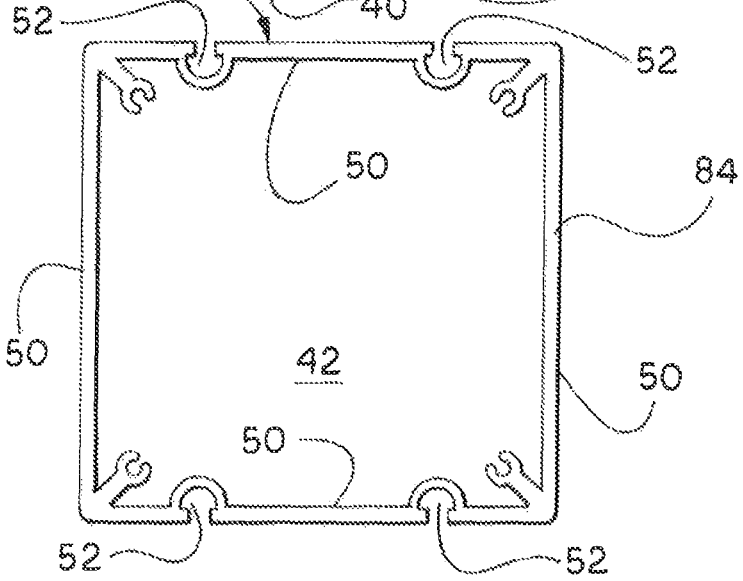
FIG. 8C is a top plan view of a two-way straight connection block in accordance with the present invention.
Figure 8D:
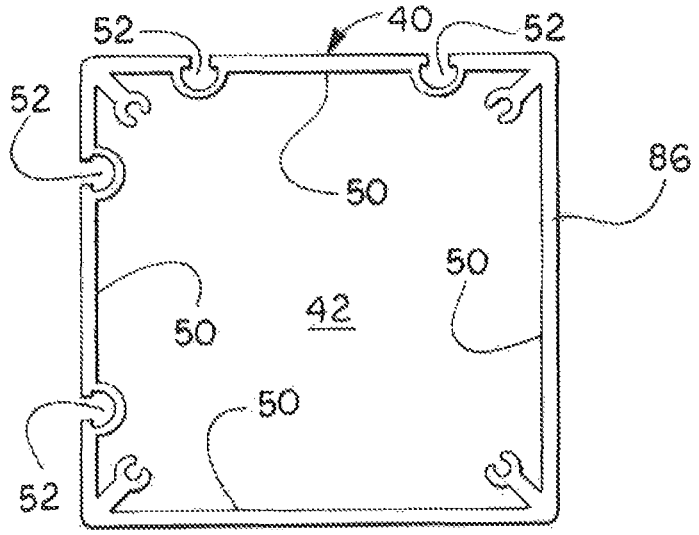
FIG. 8D is a top plan view of a two-way 90° connection block in accordance with the present invention.
Figure 8E:
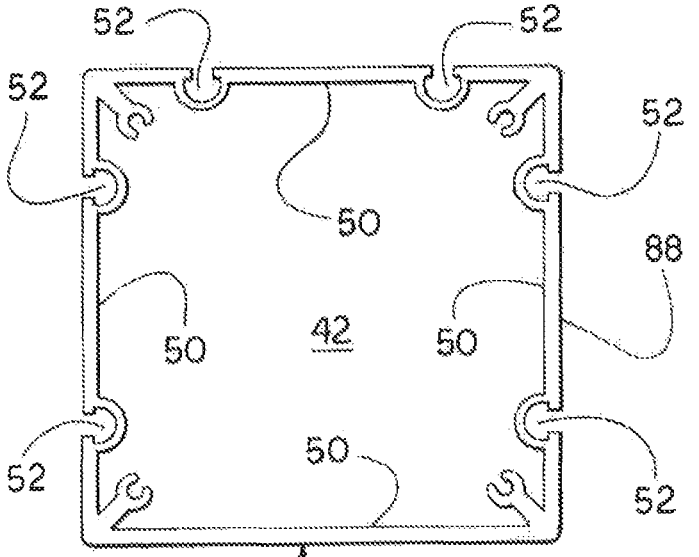
FIG. 8E is a top plan view of a three-way T connection block in accordance with the present invention.
Figure 8F:
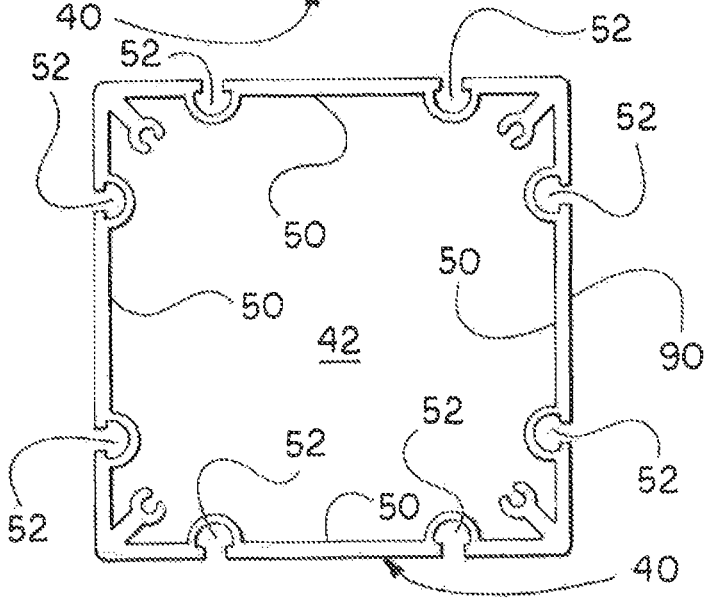
FIG. 8F is a top plan view of a four-way cross connection block in accordance with the present invention.

In one embodiment of the ceiling beam grid 16, the standard size beams 18 are hollow and four-inch square. Other sizes and shapes are contemplated by the present invention. The one embodiment has two standard size beams, one 2 feet long and the other 8 feet long. Other standard lengths are contemplated by the present invention. The bottom 20 of each beam 18 has a planar surface that faces the room, and the sides 26 of each beam also have planar surfaces that are visible from the room. The bottom 20 accommodates a variety of openings that allow for the installation of various devices, including but not limited to room lights, emergency lights, cameras, speakers, sensors, Wifi access points (WAP), cell phone repeaters, drop-down signage, and HVAC grilles. In one aspect of the invention and as illustrated in FIG. 7, each separate beam 18*a*-18*b* may be dedicated to a specific device. For example, a first beam 18*a* may support wall washer lights 70; a second beam 18*b* may support linear down lights 72; a third beam 18*c* may support individual down lights 74; a fourth beam 18*d* may support a speaker 76; a fifth beam 18*e* may support a security camera 78; and a sixth beam 18*f* may support sensors 80 (for example, temperature, occupancy, illumination, smoke, etc.). In order to reconfigure the device arrangement of the ceiling beam grid 16, one dedicated beam with a particular device is removed and replaced by another dedicated beam with a different device.

Figure 3:
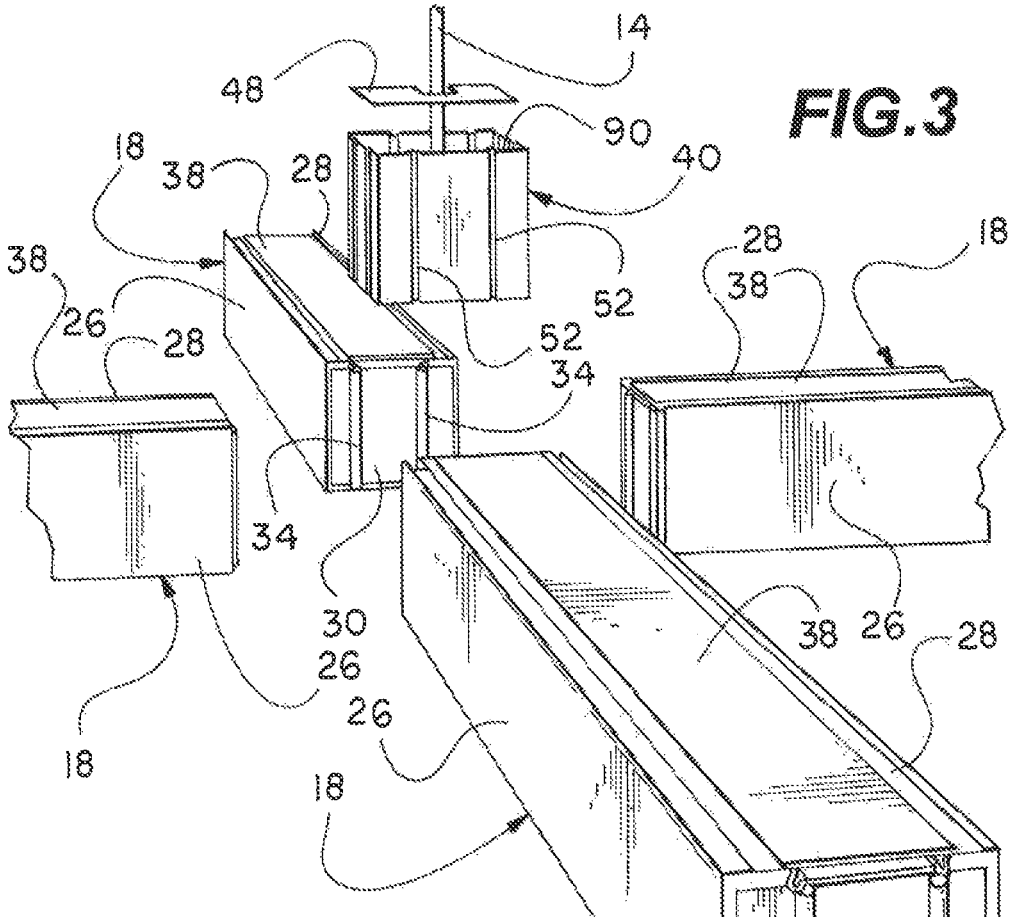
FIG. 3 is a top exploded partial perspective view of the ceiling beam grid in accordance with the present invention.
Figure 2:
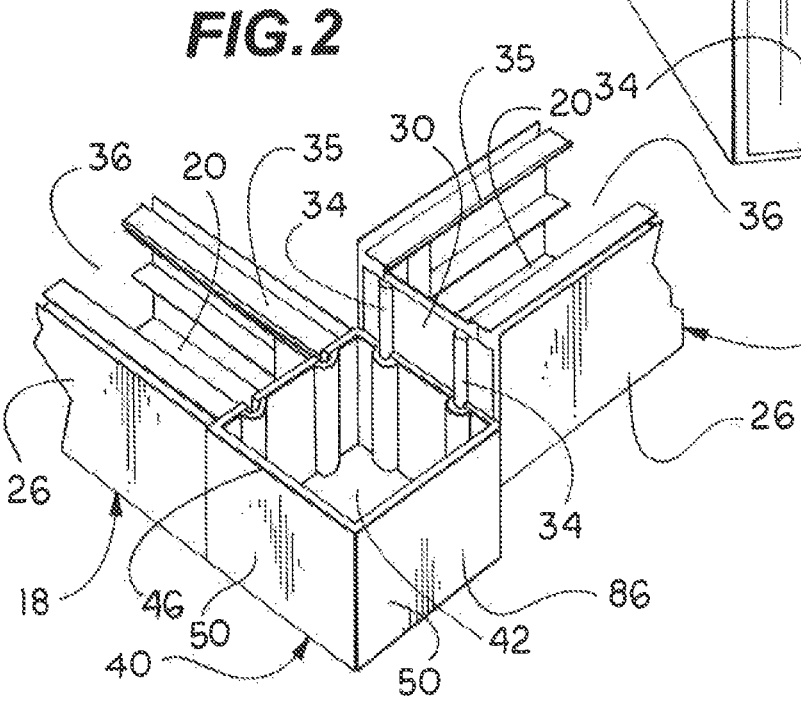
FIG. 2 is a top ceiling side partial perspective view of the ceiling beam grid in accordance with the present invention.
Figure 4:
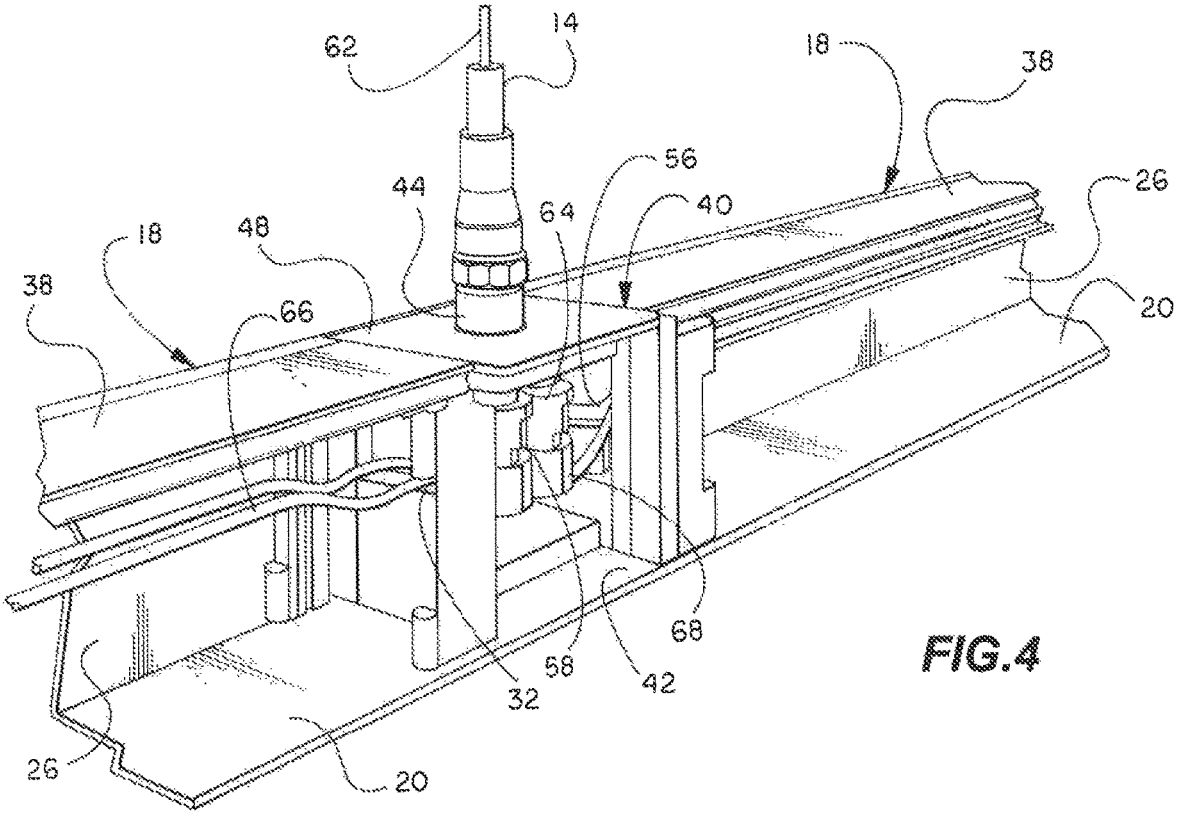
FIG. 4 is a side partial perspective view of the ceiling beam grid with sides cut away to show internal details in accordance with the present invention.

With reference to FIGS. 2, 3, and 4, the top 28 of the beam has an elongated opening 35 that allows access to a channel 36 formed by the bottom 20 and sides 26 of the beam 18. A beam cover 38 closes the top opening of the beam 18 once the devices have been installed and the electrical connections made.

Each end 30 of the beams 18 has two vertically extending tongues 34. Each end 30 of the beams 18 further has a beam wire access opening 32 that allow for wires from the connection block 40 to pass into the channel 36 of the beam 18.

The connection block 40 is a hollow square cube that is generally four-inch square to match the beam size. Other matching shapes (rectangle, triangular, hexagonal, octagonal, etc.) and sizes are contemplated by the present invention. The connection block 40 has a planar bottom surface 42 that faces the room, four planar sides 50, and a top opening 46 with a top cover 48. The connection block 40 is supported from the structural ceiling 10 by means of a ceiling anchor 12, a hanger 14 in the form of a wiring conduit, and a threaded stub 44 on the connection block 40. In one embodiment, the sides 50 of the connection block 40 have vertically extending grooves 52 that engage the matching vertically extending tongues 34 on the ends 30 of the standard size beams 18. The connection blocks 40 could have tongues and the ends 30 of the standard size beams 18 could have grooves. Other suitable disengageable connection configurations can be used as identified above. Further, the sides 50 of the connection block 40 have connection block wire access openings 56 that match the beam wire access openings 32 in the ends 30 of the beams 18 to accommodate device wires 66 running from the connection blocks 40 to the channels 36 in the beams 18 and then to the devices mounted in the bottom 20 of the beams 18.

Turning to FIGS. 8B-8F, the connection block 40 has multiple configurations including, a one-way connection block 82 with vertical grooves on one side, a two-way straight connection block 84 with vertical grooves on opposite sides, a two-way 90° connection block 86 with vertical grooves on adjacent sides, a three-way connection block 88 with vertical grooves on three sides, and a four-way connection block 90 with vertical grooves on all four sides. The configurations allow the connection block to serve as an end piece for a beam (one-way connection block 88), an extension piece (two-way straight connection block 84), a corner piece (two-way 90° connection block 86), a T connector piece (three-way connection block 88), and a cross piece (four-way connection block 90).

Figure 9A:
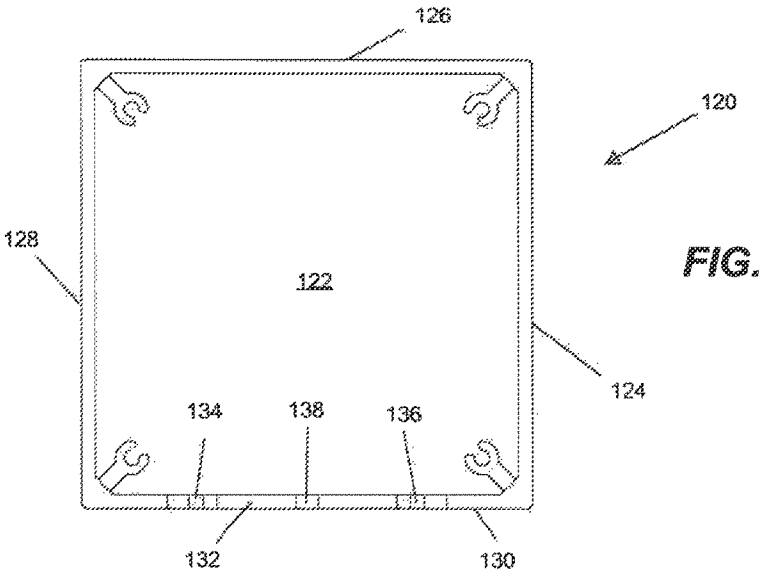
FIG. 9A is a top plan view of a second embodiment of a one-way connection block in accordance with the present invention.
Figure 9B:
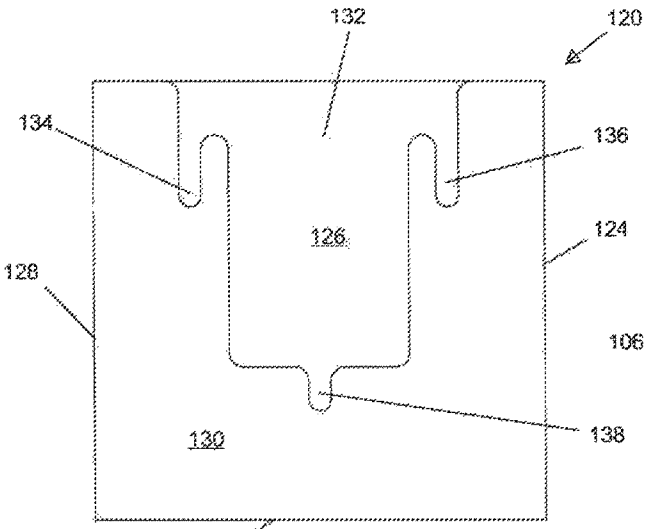
FIG. 9B is an end elevation view of the second embodiment of the one-way connection block in accordance with the present invention.
Figure 9C:
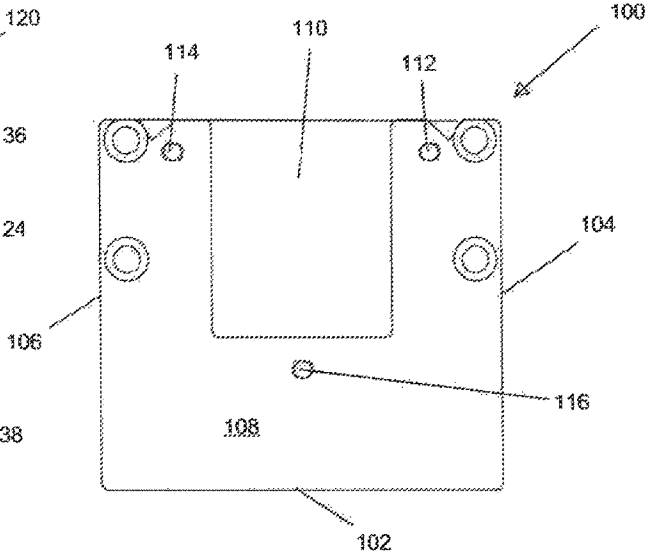
FIG. 9C is an end elevation view of a second embodiment of a beam in accordance with the present invention.

Turning to FIGS. 9A-9C, a second embodiment of the connection between a beam 100 and a one-way connection block 120 is illustrated. The one-way connection block 120 includes a bottom wall 122, plain side walls 124, 126, and 128, and connection end wall 130. With reference to FIG. 9B, the connection end wall 130 of the one-way connection block 120 has a cutout 132. The cutout 132 defines a first upper slot 134, a second upper slot 136, and a lower slot 138.

With reference to FIG. 9C, the beam 100 includes a bottom wall 102, plain side walls 104 and 106, and connection end wall 108. The end wall 108 has a cutout 110, a first upper stud 112, a second upper stud 114, and a lower stud 116. The studs 112, 114, and 116 are threaded and protrude outwardly from the end wall 108.

In order to connect the beam 100 to the connection block 120, the end wall 108 of the beam 100 is matched to the end wall 130 of the connection block 120. The protruding studs 112, 114, and 116 of the end wall 108 of the beam 100 are dropped into the matching slots 134, 136, and 138 of the end wall 130 of the connection block 120. Particularly, first upper stud 112 engages the first upper slot 134, the second upper stud 114 engages the second upper slot 136, and the lower stud 116 engages the lower slot 138. Nuts and washers (not shown) are fitted to the studs 112, 114, and 116 from the inside of the end wall 130 of the connection block 120. Tightening the nuts secures the beam 100 to the one-way connection block 120. Once the beam 100 and the connection block 120 are joined together, the cutout 110 of the beam 100 matches the cutout 132 of the connection block 120 and thereby provides an opening for running wires between the connection block 120 to the beam 100.

The ceiling beam grid 16 includes electrical drivers (not shown) located remotely from the ceiling beam grid 16. The drivers provide low voltage power to the ceiling beam grid 16 as well as control signals for controlling the devices. The drivers are connected to the ceiling beam grid 16 by driver wires 62 running from the drivers to one or more of the connection blocks 40. The driver wires terminate in an electrical multiport box 58 located in the connection block 40. The multiport box 58 has female receptacles 64 on each of its four sides. The female receptacles 64 provide connections for low voltage and control signals in each of the four directions defined by the sides 50 of the connection block 40. Device wires 66 from devices installed in the beams 18 run from the devices through the channel 36 of the beam 18, through the matching hole 32 in the end 30 of the beam 18 and the hole 56 in the side 50 of the connection block 40 and terminate in male plugs 68.

The ceiling beam grid 16 is assembled by first suspending the connection blocks 40 from the structural ceiling 10 by means of the anchor 12 and hanger 14 attached to the threaded stub 44 of the connection block 40. The connection blocks 40 are spaced to accommodate the standard size beam dimensions and the room layout. The hanger 14 is a conduit through which the driver wires 62 are threaded from the remotely located driver or drivers to the electrical multiport box 58 in the connection blocks 40. Once the connection blocks 40 have been hung from the structural ceiling 10, the standard size beams 18 are connected between the properly spaced connection blocks 40. The installation of the standard size beams 18 is accomplished without the need for tools by sliding the vertical tongues 34 on the ends 30 of the beams 18 into the matching vertical grooves 52 on the sides 50 of the connection blocks 40. The vertical sliding of the tongues 34 of the beams 18 into the grooves 52 of the connection block 40 is arrested by stops at the end of the grooves 52 or tongues 34.

Once the beams 18 have been installed, the wiring of the devices is accomplished by inserting the plugs 68 into the receptacles 64 of the multiport box 58 to connect the low voltage power and the control signals to the devices in each of the beams 18. The installation is complete by attaching the top covers 38 to the beams 18 and top covers 48 to the connection blocks 40.

While this invention has been described with reference to preferred embodiments thereof, it is to be understood that variations and modifications can be affected within the spirit and scope of the invention as described herein and as described in the appended claims.

We claim:

1. A ceiling beam grid suspended from a structural ceiling by an anchor and a hanger, the ceiling beam grid comprising:

a. one or more beams, each beam comprising:

i. a bottom for supporting a device;

ii. sides; and iii. an end with a first connector and a beam wire access opening;

b. a connection block comprising:

i. sides, one or more of which includes a second connector configured for detachable connection to the first connector of the one or more beams;

ii. a connection block wire access opening for alignment with the beam wire access opening with the connection block and one of the one or more beams connected together;

iii. a connection block support capable of engaging the hanger supported by the anchor attached to the structural ceiling;

wherein the ceiling beam grid further includes device wires for providing control signals and power to the device and wherein the connection block includes an electrical multiport box for receiving control signals and power from a source, wherein the electrical multiport box is releasably connected to the device wires for connecting the control signals and power to the device, and wherein the device wires extend through the beam wire access opening and the connection block wire access opening of one of the one or more beams.

2. The ceiling beam grid of claim 1, wherein each beam of the one or more beams has a particular device.

3. The ceiling beam grid of claim 1, wherein the first connector and second connector constitute a tongue and groove connection.

4. The ceiling beam grid of claim 1, wherein the second connector of the connection block is configured on one side of the connection block.

5. The ceiling beam grid of claim 1, wherein the second connector of the connection block is configured on opposite sides of the connection block.

6. The ceiling beam grid of claim 1, wherein the second connector of the connection block is configured on two adjacent sides of the connection block.

7. The ceiling beam grid of claim 1, wherein the second connector of the block is configured on adjacent sides of the connection block.

8. The ceiling beam grid of claim 1, wherein the second connector of the connection block is configured on four sides of the connection block.

* * * * *